US010010935B2

(12) United States Patent
Takashita et al.

(10) Patent No.: US 10,010,935 B2
(45) Date of Patent: Jul. 3, 2018

(54) IRON POWDER FOR DUST CORES

(71) Applicant: JFE STEEL CORPORATION, Tokyo (JP)

(72) Inventors: Takuya Takashita, Chiba (JP); Naomichi Nakamura, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/442,217

(22) PCT Filed: Dec. 2, 2013

(86) PCT No.: PCT/JP2013/007055

§ 371 (c)(1),
(2) Date: May 12, 2015

(87) PCT Pub. No.: WO2014/097556

PCT Pub. Date: Jun. 26, 2014

(65) Prior Publication Data

US 2016/0303652 A1 Oct. 20, 2016

(30) Foreign Application Priority Data

Dec. 19, 2012 (JP) ..... 2012-277424

(51) Int. Cl.

| | |
|---|---|
| ***B22F 1/00*** | (2006.01) |
| ***C22C 38/00*** | (2006.01) |
| ***H01F 1/20*** | (2006.01) |
| ***H01F 3/08*** | (2006.01) |
| ***B22F 9/08*** | (2006.01) |
| ***B22F 9/20*** | (2006.01) |
| ***C21D 1/26*** | (2006.01) |
| ***C21D 3/02*** | (2006.01) |
| ***C21D 3/04*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| *C22C 33/02* | (2006.01) |

(52) U.S. Cl.

CPC ..... *B22F 1/0062* (2013.01); *B22F 1/0014* (2013.01); *B22F 9/082* (2013.01); *B22F 9/20* (2013.01); *C21D 1/26* (2013.01); *C21D 3/02* (2013.01); *C21D 3/04* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *H01F 1/20* (2013.01); *H01F 3/08* (2013.01); *B22F 2009/0828* (2013.01); *B22F 2301/35* (2013.01); *B22F 2304/10* (2013.01); *B22F 2998/10* (2013.01); *C22C 33/02* (2013.01); *C22C 2202/02* (2013.01)

(58) Field of Classification Search

CPC ..... B22F 1/0062; B22F 1/0014
USPC ..... 75/255
See application file for complete search history.

(56) References Cited

U.S. PATENT DOCUMENTS

| | | | | |
|---|---|---|---|---|
| 5,800,636 | A * | 9/1998 | Tsukada | H01F 41/0246 148/306 |
| 2003/0070508 | A1* | 4/2003 | Ozaki | B22F 1/0014 75/255 |
| 2007/0186722 | A1* | 8/2007 | Hanejko | B22F 1/0059 75/252 |
| 2007/0203051 | A1* | 8/2007 | Vidarsson | B22F 1/0059 510/446 |
| 2012/0048063 | A1* | 3/2012 | Maetani | C22C 33/0271 75/246 |
| 2013/0015394 | A1* | 1/2013 | Skarman | B22F 1/02 252/62.55 |
| 2013/0269249 | A1* | 10/2013 | Kawano | A01C 1/06 47/57.6 |
| 2016/0303652 | A1 | 10/2016 | Takashita et al. | |

FOREIGN PATENT DOCUMENTS

| | | | |
|---|---|---|---|
| JP | H06-002007 | A | 1/1994 |
| JP | 2002-317204 | A | 10/2002 |
| JP | 2005-187918 | A | 7/2005 |
| JP | 2007-092162 | A | 4/2007 |
| JP | 2007-194273 | A | 8/2007 |
| JP | 4078512 | B2 | 4/2008 |
| JP | WO2012029969 | * | 3/2012 |
| WO | 2008/093430 | A1 | 8/2008 |

OTHER PUBLICATIONS

Aug. 13, 2015 Office Action issued in Korean Patent Application No. 2015-7015499.
Feb. 10, 2014 International Search Report issued in International Application No. PCT/JP2013/007055.
Aug. 28, 2017 Office Action issued in U.S. Appl. No. 14/764,273.

* cited by examiner

*Primary Examiner* — Colleen P Dunn
*Assistant Examiner* — Nicholas A Wang
(74) *Attorney, Agent, or Firm* — Oliff PLC

(57) ABSTRACT

The present invention provides iron powder for dust cores that has excellent compressibility and low iron loss after formation. In the iron powder for dust cores, Si content is 0.01 mass % or less, apparent density is 3.8 g/cm$^3$ or more, the ratio of iron powder particles with a particle size of 45 μm or less is 10 mass % or less, the ratio of iron powder particles with a particle size of over 180 μm and 250 μm or less is less than 30 mass %, the ratio of iron powder particles with a particle size of over 250 μm is 10 mass % or less, and the Vickers hardness (test force: 0.245 N) of a powder cross-section is 80 Hv or less.

7 Claims, No Drawings

IRON POWDER FOR DUST CORES

TECHNICAL FIELD

The present invention relates to iron powder for dust cores that allows for production of a dust core that has low iron loss and is high density.

BACKGROUND

Magnetic cores used in motors, transformers, and the like are required to have high magnetic flux density and low iron loss. Conventionally, electrical steel sheets have been stacked in such magnetic cores, yet in recent years, dust cores have attracted attention as magnetic core material for motors.

The most notable characteristic of a dust core is that a 3D magnetic circuit can be formed. Since electrical steel sheets are stacked to form a magnetic core, the degree of freedom for the shape is limited. A dust core, on the other hand, is formed by pressing soft magnetic particles coated with insulating coating. Therefore, all that is needed is a die in order to obtain a greater degree of freedom for the shape than with electrical steel sheets.

Press forming is also a shorter process than stacking steel sheets and is less expensive. Combined with the low cost of the base powder, dust cores achieve excellent cost performance. Furthermore, since the surfaces of the stacked steel sheets are insulated, the magnetic properties in the steel sheet surface direction and the direction perpendicular to the surface differ, causing electrical steel sheets to have the defect of poor magnetic properties in the direction perpendicular to the surface. By contrast, in a dust core, each particle is coated with insulating coating, yielding uniform magnetic properties in every direction. A dust core is therefore appropriate for use in a 3D magnetic circuit.

Dust cores are thus indispensable material for designing 3D magnetic circuits, and due to their excellent cost performance, they have also been used in recent years from the perspectives of reducing the size of motors, reducing rare earth elements, reducing costs, and the like. Research and development of motors with 3D magnetic circuits has thus flourished.

When manufacturing high-performance magnetic components using powder metallurgy techniques, the components are required to be high density and to have excellent iron loss properties after formation. By increasing density, the magnetic flux density and the magnetic permeability of the iron core increase, allowing for generation of high torque with low current. Furthermore, reducing iron loss improves motor efficiency.

Against the above-described background, a variety of high compressibility iron powders have been developed. For example, JP 2007-92162 A (PTL 1) and WO 2008-093430 (PTL 2) disclose techniques related to a high compressibility iron powder that includes by mass %, as impurities, C: 0.005% or less, Si: more than 0.01% and 0.03% or less, Mn: 0.03% or more to 0.07% or less, P: 0.01% or less, S: 0.01% or less, O: 0.10% or less, and N: 0.001% or less, wherein a particle of the iron powder has an average crystal grain number of 4 or less and a micro Vickers hardness Hv of 80 or less on average.

JP H06-2007 A (PTL 3) discloses pure iron powder for powder metallurgy with excellent compressibility and magnetic properties. The impurity content of the iron powder is C≤0.005%, Si≤0.010%, Mn≤0.050%, P≤0.010%, S≤0.010%, O≤0.10%, and N≤0.0020%, the balance being substantially Fe and incidental impurities. The particle size distribution is, on the basis of weight percent by sieve classification using sieves prescribed in JIS Z 8801, constituted by 5% or less of particles of −60/+83 mesh, 4% or more to 10% or less of particles of −83/+100 mesh, 10% or more to 25% or less of particles of −100/+140 mesh, and 10% or more to 30% or less of particles passing through a sieve of 330 mesh. Crystal grains included in particles of −60/+200 mesh are coarse crystal grains with an average grain size number of 6.0 or less as measured by a ferrite grain size measuring method prescribed in JIS G 0052. When 0.75% of zinc stearate is blended as a lubricant for powder metallurgy and the result is compacted with a die at a compacting pressure of 5 t/cm$^2$, a green density of 7.05 g/cm$^3$ or more is obtained.

Furthermore, JP 4078512 B2 (PTL 4) discloses a high compressibility iron powder 1 such that the particle size distribution of iron powder is, on the basis of mass % by sieve classification using sieves prescribed in JIS Z 8801, constituted by more than 0% to 45% or less of particles that pass through a sieve having a nominal dimension of 1 mm and do not pass through a sieve having a nominal dimension of 250 μm, 30% or more to 65% or less of particles that pass through a sieve having a nominal dimension of 250 μm and do not pass through a sieve having a nominal dimension of 180 μm, 4% or more to 20% or less of particles that pass through a sieve having a nominal dimension of 180 μm and do not pass through a sieve having a nominal dimension of 150 μm, and 0% or more to 10% or less of particles that pass through a sieve having a nominal dimension of 150 μm; the micro Vickers hardness of iron powder particles that do not pass through the sieve having a nominal dimension of 150 μm is 110 or less; and the impurity content of the iron powder is, by mass %, C≤0.005%, Si≤0.01%, Mn≤0.05%, P≤0.01%, S≤0.01%, O≤0.10%, and N≤0.003%. PTL 4 also discloses a high compressibility iron powder 2 such that the particle size distribution of iron powder is, on the basis of mass % by sieve classification using sieves prescribed in JIS Z 8801, constituted by more than 0% to 2% or less of particles that pass through a sieve having a nominal dimension of 1 mm and do not pass through a sieve having a nominal dimension of 180 μm, 30% or more to 70% or less of particles that pass through a sieve having a nominal dimension of 180 μn and do not pass through a sieve having a nominal dimension of 150 μm, and 20% or more to 60% or less of particles that pass through a sieve having a nominal dimension of 150 μm; the micro Vickers hardness of iron powder particles that do not pass through the sieve having a nominal dimension of 150 μm is 110 or less; and the impurity content of the iron powder is, by mass %, C≤0.005%, Si≤0.01%, Mn≤0.05%, P≤0.01%, S≤0.01%, O≤0.10%, and N≤0.003%.

CITATION LIST

Patent Literature

PTL 1: JP 2007-92162 A
PTL 2: WO 2008-093430
PTL 3: JP H06-2007 A
PTL 4: JP 4078512 B2

While the techniques disclosed in PTL 1 and PTL 2 yield a high density green compact, these documents make no mention of iron loss. Sufficient consideration has thus not been given to reduction of iron loss.

Like PTL 1 and PTL 2, PTL 3 also mainly discloses an examination of increased density and the like, and disclosure related to reduction of iron loss is again insufficient.

Furthermore, like the techniques disclosed in PTL 1 to PTL 3, the high compressibility iron powders 1 and 2 of PTL 4 are both specialized for increasing magnetic flux density, and no consideration is made for reducing iron loss.

The present invention has been developed in light of the above circumstances and provides iron powder for dust cores that has excellent compressibility and low iron loss after formation.

SUMMARY

As a result of intensive studies on iron powder for dust cores that are high density after formation and that have low iron loss, the inventors of the present invention discovered the following about pure iron powder obtained by a water atomizing method:

(1) If Si ends up being included to at least a certain degree in molten steel, the compressibility of the iron powder worsens, causing iron loss to increase;

(2) If the apparent density is low, iron loss increases;

(3) An appropriate range for the particle size distribution of the iron powder exists, and if there is too much coarse powder or fine powder, iron loss increases; and (4) If the hardness of a cross-section of the iron powder is high, compressibility reduces.

The present invention is based on these findings.

Specifically, primary features of the present invention are as follows.

An iron powder for dust cores, comprising pure iron powder obtained by a water atomizing method, wherein in the pure iron powder, Si content is 0.01 mass % or less;

an apparent density is 3.8 g/cm$^3$ or more;

a ratio of iron powder particles with a particle size of 45 μm or less is 10 mass % or less;

a ratio of iron powder particles with a particle size of over 180 μm and 250 μm or less is less than 30 mass %;

a ratio of iron powder particles with a particle size of over 250 μm is 10 mass % or less; and a Vickers hardness (test force: 0.245 N) of a powder cross-section is 80 Hv or less.

The present invention provides iron powder for dust cores that allows for production of a dust core that has low iron loss and is high density.

DETAILED DESCRIPTION

The present invention will be described in detail below.

First, the reasons for the numerical limitations of the present invention are described.

(Si Content)

If Si is included in molten steel, the pure iron powder obtained by a water atomizing method (also referred to simply as powder or iron powder) oxidizes at the time of water atomizing, and an oxide-based inclusion forms in the particle, thereby increasing hysteresis loss. Furthermore, fine Si oxides forming at the time of water atomizing and solute Si that does not oxidize at the time of atomizing harden the powder, causing the compressibility to lower. For these reasons, it is essential to reduce Si content insofar as possible. In the present invention, a range of 0.01 mass % or less is adopted. The content may also be 0 mass %.

(Apparent Density)

The iron powder is subjected to plastic deformation by press forming to yield a high-density green compact. As the amount of plastic deformation at this time of formation is smaller, the crystal grains after stress relief annealing grow coarse, and as described below, fine iron powder with a particle size of 45 μm or less greatly increases hysteresis loss. Therefore, the amount of plastic deformation needs to be reduced insofar as possible.

In order to reduce the amount of plastic deformation of the powder at the time of formation, the filling rate of the powder into the die needs to be increased. In the present invention, an apparent density of the powder of 3.8 g/cm$^3$ or more is essential and an apparent density of 4.0 g/cm$^3$ or more is preferable. The reason is that if the apparent density falls below 3.8 g/cm$^3$, a large amount of stress is introduced into the powder at the time of formation, and the crystal grains after stress relief annealing are refined. Note that the apparent density is an index indicating the degree of the filling rate of the powder and can be measured with the experimental method prescribed in JIS Z 2504.

(Amounts of Fine Powder and Coarse Powder)

In the iron powder according to the present invention, particles with a particle size of over 45 μm and 180 μm or less are predominant (i.e. 50 mass % or more, with 100 mass % being acceptable). Since fine iron powder with a particle size of 45 μm or less greatly increases hysteresis loss, however, such fine iron powder needs to be reduced insofar as possible, with an amount of 10 mass % or less being essential and 5 mass % or less being preferable. The amount may also be 0 mass %. Note that the ratio of 45 μm or less iron powder can be calculated by sieving with a sieve prescribed in JIS Z 8801-1.

Since the compressibility of coarse iron powder with a particle size of over 180 μm is high, such coarse iron powder needs to be included at a particular ratio, yet excessive inclusion leads to an increase in eddy current loss. Therefore, iron powder with a particle size of over 180 μm and 250 μm or less needs to be set to less than 30 mass %, and iron powder exceeding 250 μm needs to be set to 10 mass % or less.

Iron powder with a particle size of over 180 μm and 250 μm or less is preferably set to 25 mass % or less, and iron powder exceeding 250 μm is preferably set to 5 mass % or less. These amounts may also each be 0 mass %.

(Vickers Hardness)

If the powder is hard, a larger compacting pressure is required to increase the density of the green compact. Therefore, the powder needs to be softened insofar as possible, and it is essential that the hardness (Hv) in a Vickers hardness test with a test force of 0.245 N be 80 or less. Hv is preferably 75 or less. The Vickers hardness can be measured by the following method.

First, the iron powder to be measured is mixed into thermoplastic resin powder. The resulting mixed powder is then injected into an appropriate mold and heated to melt the resin. The result is cooled and hardened to yield a resin solid containing iron powder. An appropriate cross-section of this resin solid containing iron powder is cut, and the resulting face is polished. After removing this polished, treated layer by corrosion, the hardness of the iron powder is measured using a micro Vickers hardness gauge (test force: 0.245 N (25 gf)). With one measurement point per particle, the hardness of at least ten particles is preferably measured, with the average then being taken. The powder that is measured needs to be of a size that can accommodate indentations and hence preferably has a powder particle size of 100 μm or more. Other than the above-described points, measurement is performed in accordance with JIS Z 2244.

Next, a representative method of manufacturing a product according to the present invention is described. Of course, a method other than the one described below may be used to obtain a product according to the present invention.

The iron powder for dust cores in the present invention is obtained by a water atomizing method, and other than Si, C, O, S, and N, the molten steel has the composition of regular pure iron powder. The content of Si is set so that Si≤0.01 mass %. For deoxidation, C may be added beyond the composition of the pure iron powder, yet by a subsequent decarburization process, the final C content is preferably reduced to 0.01 mass % or less. Furthermore, since O, S, and N can be removed by performing annealing in a hydrogen atmosphere during a subsequent process, relatively large amounts of these elements as compared to the composition of the pure iron powder may be mixed in, yet if the amounts are too large, the burden for reduction annealing increases, and therefore insofar as possible the amounts are preferably brought close to the composition of pure iron powder.

In this context, the composition of pure iron powder is a composition equivalent to 300A, which is a pure iron powder for powder metallurgy marketed by JFE Steel Corporation.

Next, this powder is subjected to reduction annealing. Reduction annealing is preferably performed in a reductive atmosphere that includes hydrogen and is preferably performed at a temperature of 800° C. or more to less than 1100° C. for 1 h or more to 5 h or less. When the iron power after atomizing includes a large amount of C, reduction annealing is performed with water vapor included in the hydrogen. The amount of water vapor need not be restricted and may be modified appropriately in response to the amount of C in the iron powder. Water vapor is typically added to achieve a dew point of approximately 30° C. to 60° C.

Since a portion of the iron powder after reduction annealing is agglomerated, the agglomeration is broken up by a crushing process, and the result is sieved so that particles of 45 μm or less constitute 10 mass % or less. The iron powder may also be sieved appropriately so as to remove coarse powder. This sieving may be accomplished with a method using a sieve prescribed in JIS Z 8801-1.

If the apparent density of the sieved iron powder is less than 3.8 g/cm$^3$, separate particle size adjustment or spheroidization (for example, JP S64-21001 B2) may be applied to set the apparent density to 3.8 g/cm$^3$ or more. When subjecting the iron powder to spheroidization, in order to remove stress during processing, stress relief annealing is preferably applied in a hydrogen atmosphere at a temperature of 700° C. to 850° C. for approximately 1 h to 5 h.

In order to obtain a dust core from the iron powder produced as above, an insulating coating is preferably applied to the iron powder surface. This insulating coating may be any coating capable of maintaining insulation between particles. Examples of such an insulating coating include silicone resin; a vitreous insulating amorphous layer with metal phosphate or metal borate as a base; a metal oxide such as MgO, forsterite, talc, or $Al_2O_3$; or a crystalline insulating layer with $SiO_2$ as a base.

The iron powder to which the insulating coating has been applied is injected in a die and pressure formed to a shape with desired dimensions (dust core shape) to yield a dust core. The pressure formation method may be any regular formation method, such as cold molding, die lubrication molding, or the like. The compacting pressure and die temperature are appropriately determined in accordance with use. If the compacting pressure is increased, the green density increases. Hence, a compacting pressure of 981 MPa (10 t/cm$^2$) or more is preferable, with 1471 MPa (15 t/cm$^2$) or more being more preferable. On the other hand, no restriction is placed on the upper limit of the compacting pressure, yet in view of restrictions on manufacturing facilities, the upper limit may be approximately 1960 MPa (20 t/cm$^2$).

Even if the die temperature is increased, the green density rises. Therefore, the die temperature is preferably 80° C. or more and more preferably 100° C. or more. On the other hand, no restriction is placed on the upper limit of the die temperature, yet in view of restrictions on manufacturing facilities, the upper limit may be approximately 300° C.

Of course, the above formation conditions may be changed appropriately in accordance with use. At the time of pressure formation, as necessary, a lubricant may be applied to the die walls or added to the powder.

At the time of pressure formation, the friction between the die and the powder can thus be reduced, suppressing a reduction in the green density. Furthermore, the friction upon removal from the die can also be reduced, thereby preventing cracks in the green compact (dust core) at the time of removal. Preferable lubricants include metallic soaps such as lithium stearate, zinc stearate, and calcium stearate, and waxes such as fatty acid amide.

After pressure formation, the dust core is subjected to heat treatment in order to reduce hysteresis loss due to stress relief and to increase the green compact strength. The heat treatment time is preferably in the range of 5 min to 120 min. Any of the following may be used without any problem as the heating atmosphere: the regular atmosphere, an inert atmosphere, a reductive atmosphere, or a vacuum. The atmospheric dew point may be determined appropriately in accordance with use. Furthermore, when raising or lowering the temperature during heat treatment, a stage at which the temperature is maintained constant may be provided.

EXAMPLES

In the present Example, 11 types of pure iron powder obtained by a water atomizing method and having the characteristics in Table 1 were used. Other than the element Si, the following ranges were satisfied in all of the samples: C≤0.01 mass %, N≤0.005 mass %, O≤0.1 mass %, Al≤0.01 mass %, P≤0.01 mass %, S≤0.01 mass %, Mn≤0.1 mass %, and Cr≤0.1 mass %.

TABLE 1

| Sample number | Si content (mass %) | Apparent density (g/cm$^3$) | Particle size ratio (mass %) 45 μm or less | Over 180 μm and 250 μm or less | Over 250 μm | Vickers hardness (Hv) | Other | Notes |
|---|---|---|---|---|---|---|---|---|
| 1 | 0.006 | 4.3 | 3 | 21 | 0 | 73 | — | Inventive example |
| 2 | 0.008 | 4.2 | 6 | 21 | 0 | 76 | — | Inventive example |
| 3 | 0.019 | 4.2 | 5 | 22 | 0 | 78 | Corresponds to PTL 1 and PTL 2 | Comparative example |
| 4 | 0.027 | 4.2 | 3 | 21 | 0 | 80 | — | Comparative example |
| 5 | 0.066 | 4.3 | 2 | 23 | 0 | 83 | — | Comparative example |
| 6 | 0.137 | 4.2 | 4 | 20 | 0 | 89 | — | Comparative example |
| 7 | 0.006 | 4.3 | 13 | 17 | 0 | 72 | Particle size out of range (corresponds to PTL 3) | Comparative example |
| 8 | 0.006 | 4.4 | 3 | 21 | 0 | 86 | — | Comparative example |
| 9 | 0.006 | 3.6 | 4 | 20 | 0 | 72 | — | Comparative example |
| 10 | 0.006 | 4.2 | 0 | 56 | 35 | 72 | Corresponds to PTL 4 | Comparative example |
| 11 | 0.006 | 4.2 | 0 | 40 | 5 | 72 | Corresponds to PTL 4 | Comparative example |

An insulating coating was applied to the powders listed in Table 1 using silicone resin. After dissolving the silicone resin in toluene to produce a resin dilute solution such that the resin component is 0.9 mass %, the powder and the resin dilute solution were mixed so that the rate of addition of the resin with respect to the powder became 0.1 mass %. The result was then dried in the atmosphere. After drying, a resin baking process was performed in the atmosphere at 200° C. for 120 min to yield iron powders coated in silicone resin.

These powders were then molded by die lubrication at a compacting pressure of 1471 MPa (15 t/cm$^2$) to produce ring-shaped test pieces with an outer diameter of 38 mm, an inner diameter of 25 mm, and a height of 6 mm. After subjecting the produced test pieces to heat treatment in nitrogen at 600° C. for 45 min, winding was performed (primary winding, 100 turns; secondary winding, 40 turns). Magnetic flux density measurement with a DC magnetizing device (H=10000 A/m, DC magnetizing measurement device produced by METRON, Inc.) and iron loss measurement with an iron loss measurement device (1.0 T, 1 kHz, high-frequency iron loss measurement device produced by METRON, Inc.) were then performed.

Table 2 shows the measurement results of density and magnetic properties of the green compact along with green density. In the present Example, the acceptance criterion for magnetic flux density was $B_{100} \geq 1.70$ T, and the acceptance criterion for iron loss was $W_{10/1K} \leq 80$ W/kg.

Table 2 also lists the measurement results for the crystal grains.

TABLE 2

| Sample number | Green density (g/cm$^3$) | Magnetic flux density (T) | Iron loss (W/kg) | Notes |
|---|---|---|---|---|
| 1 | 7.72 | 1.71 | 72.1 | Inventive example |
| 2 | 7.71 | 1.70 | 73.2 | Inventive example |
| 3 | 7.67 | 1.62 | 82.8 | Comparative example |
| 4 | 7.65 | 1.61 | 81.5 | Comparative example |
| 5 | 7.57 | 1.58 | 86.7 | Comparative example |
| 6 | 7.61 | 1.56 | 119.5 | Comparative example |
| 7 | 7.63 | 1.60 | 96.1 | Comparative example |
| 8 | 7.58 | 1.58 | 91.6 | Comparative example |
| 9 | 7.68 | 1.71 | 99.7 | Comparative example |
| 10 | 7.73 | 1.72 | 85.0 | Comparative example |
| 11 | 7.72 | 1.72 | 82.0 | Comparative example |

Table 2 shows that the inventive examples according to the present invention (sample numbers 1 and 2) not only have a high green density but also pass the acceptance criteria for both magnetic flux density ($B_{100}$) and iron loss ($W_{10/1K}$) and thus have excellent magnetic properties.

By contrast, sample numbers 3 to 6, in which the Si content was greater than in the inventive examples, did not meet the acceptance criteria for either magnetic flux density or iron loss. From the results for sample numbers 3 to 6, it is clear that increasing the Si content tends to reduce the magnetic flux density and increase iron loss. The reason is thought to be that the powder hardens along with an increase in Si content and that fine oxides produced at the time of water atomizing increase.

Sample number 7, which includes more iron powder with a particle size of 45 μm or less than do the inventive examples, and sample number 8, which has high powder hardness, also did not meet the acceptance criteria for either magnetic flux density or iron loss.

For sample number 7, it is inferred that the increase in fine powder led to a reduction in compressibility and to an increase in total iron loss due to an increase in hysteresis loss. On the other hand, for sample number 8, it was thought that hardness of the powder increased due to the fineness of crystal grains in the powder or to the accumulation of strain, which in turn was thought to lead to reduced compressibility and an increase in total iron loss due to an increase in hysteresis loss.

Although sample numbers 9, 10, and 11 satisfied the acceptance criterion for magnetic flux density, they did not meet the acceptance criterion for iron loss.

For sample number 9, it was thought that a large amount of strain accumulated during formation due to the reduction in apparent density, causing hysteresis loss to increase, thus resulting in increased iron loss. By contrast, sample numbers 10 and 11 had high compressibility due to the inclusion of much coarse powder and exhibited higher green density and magnetic flux density than did the inventive examples, yet it was thought that these samples did not meet the acceptance criterion for iron loss due to the coarse powder causing an increase in eddy current loss.

The invention claimed is:

1. An iron powder for dust cores, the iron powder comprising iron powder obtained by a water atomizing method, wherein:

in the iron powder:

Si content is 0.01 mass % or less;

C content is 0.01 mass % or less;

N content is 0.005 mass % or less;

O content is 0.1 mass % or less;

Al content is 0.01 mass % or less;

P content is 0.01 mass % or less;

S content is 0.01 mass % or less;

Mn content is 0.1 mass % or less;

Cr content is 0.1 mass % or less;

an apparent density is 3.8 g/cm$^3$ or more;

a ratio of iron powder particles with a particle size of 45 μm or less is more than 0 mass % and 5 mass % or less;

a ratio of iron powder particles with a particle size of over 45 μm and 180 μm or less is 50 mass % or more and less than 100 mass %;

a ratio of iron powder particles with a particle size of over 180 μm and 250 μm or less is less than 30 mass %;

a ratio of iron powder particles with a particle size of over 250 μm is 10 mass % or less; and a Vickers hardness (test force: 0.245 N) of a powder cross-section is 80 Hv or less.

2. The iron powder for dust cores according to claim 1, wherein:

in the iron powder, Si content is more than 0 mass %.

3. The iron powder for dust cores according to claim 1, wherein:

in the iron powder, Si content is 0.006 mass % or more.

4. The iron powder for dust cores according to claim 1, wherein:

the ratio of iron powder particles with a particle size of over 180 μm and 250 μm or less is less than 25 mass %.

5. The iron powder for dust cores according to claim 1, wherein:

the ratio of iron powder particles with a particle size of over 250 μm is 5 mass % or less.

6. The iron powder for dust cores according to claim 1, wherein:

the ratio of iron powder particles with a particle size of over 250 μm is 0 mass %.

7. Dust cores including the iron powder according to claim 1.

* * * * *